US006866596B2

(12) United States Patent
Steed et al.

(10) Patent No.: US 6,866,596 B2
(45) Date of Patent: Mar. 15, 2005

(54) PORTABLE BASKETBALL SYSTEM

(75) Inventors: Brent Steed, Clearfield, UT (US); David C. Winter, Layton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 36 days.

(21) Appl. No.: 10/357,545

(22) Filed: Feb. 4, 2003

(65) Prior Publication Data

US 2003/0162611 A1 Aug. 28, 2003

Related U.S. Application Data

(60) Provisional application No. 60/354,338, filed on Feb. 4, 2002.

(51) Int. Cl.[7] ..... A63B 67/00

(52) U.S. Cl. ..... 473/472; 473/481

(58) Field of Search ..... 473/472, 481–485, 473/435, 476, 479; 248/519, 188.2, 910, 127, 128, 129, 161, 521, 525, 528, 529, 404

(56) References Cited

U.S. PATENT DOCUMENTS

| | | | |
|---|---|---|---|
| 1,924,811 | A | 8/1933 | Schulz |
| 2,818,254 | A | 12/1957 | Dunn |
| 3,025,058 | A | 3/1962 | Brumfield |
| 3,427,025 | A | 2/1969 | Procter |
| 3,841,631 | A | 10/1974 | Dolan |
| 4,412,679 | A | 11/1983 | Mahoney et al. |
| 5,207,407 | A | 5/1993 | Fitzsimmons et al. |
| 5,248,140 | A | 9/1993 | Mower et al. |
| 5,259,612 | A | 11/1993 | Matherne et al. |
| 5,375,835 | A | 12/1994 | Van Nimwegen et al. |
| 5,390,914 | A | 2/1995 | Schroeder |
| 5,415,393 | A | 5/1995 | Fitzsimmons et al. |
| 5,478,068 | A | 12/1995 | Schroeder |
| 5,489,107 | A | 2/1996 | Kho |
| 5,573,237 | A | 11/1996 | Van Nimwegen et al. |
| 5,632,480 | A | 5/1997 | Davis et al. |
| 5,730,668 | A | 3/1998 | Hege et al. |
| 5,836,838 | A | 11/1998 | Van Nimwegen et al. |
| 5,839,714 | A | 11/1998 | Fitzsimmons et al. |
| 5,839,982 | A | 11/1998 | Hying et al. |
| 5,881,537 | A | 3/1999 | Schickert et al. |
| 5,902,197 | A | 5/1999 | Davis et al. |
| 5,916,047 | A | 6/1999 | Schickert et al. |
| 5,947,847 | A | 9/1999 | Van Nimwegen et al. |
| 5,983,602 | A | 11/1999 | Allen et al. |
| 6,053,825 | A | 4/2000 | Allen et al. |
| 6,117,027 | A | 9/2000 | Davis et al. |
| 6,145,856 | A | 11/2000 | Conti |
| 6,179,733 | B1 | 1/2001 | Story |
| 6,412,747 | B2 | 7/2002 | Davis et al. |
| 6,432,003 | B1 | 8/2002 | vanNimwegen |
| 2001/0035481 | A1 | 11/2001 | Davis et al. |
| 2001/0035485 | A1 | 11/2001 | Davis et al. |
| 2001/0045498 | A1 | 11/2001 | Davis et al. |
| 2001/0045501 | A1 | 11/2001 | Davis et al. |

FOREIGN PATENT DOCUMENTS

| | | |
|---|---|---|
| CA | 2302005 | 3/2000 |

*Primary Examiner*—Sebastiano Passaniti
*Assistant Examiner*—M. Chambers
(74) *Attorney, Agent, or Firm*—Workman Nydegger

(57) ABSTRACT

A portable basketball system includes a support pole that is sized and configured to support a basketball goal above a playing surface. The portable basketball system also includes a base with a generally hollow interior that allows the base to be filled with ballast material such as sand or water. In addition, the portable basketball system may include an axle and a locking member that are connected to the support pole, and a wheel that is connected to the axle. The base may include a wheel receiving portion that receives at least a portion of the wheel and support pole, an axle receiving portion that connects the axle to the base, a support pole receiving portion that receives at least a portion of the support pole, and a locking member receiving portion that receives at least a portion of the locking member when the support pole is in a playing position.

39 Claims, 4 Drawing Sheets

PORTABLE BASKETBALL SYSTEM

CROSS-REFERENCE TO RELATED APPLICATIONS

This patent application claims priority to and the benefit of U.S. Provisional Patent Application Ser. No. 60/354,338, entitled Assembly of Pole to Portable Basketball Base, which was filed on Feb. 4, 2002, and is hereby incorporated by reference in its entirety.

BACKGROUND OF THE INVENTION

1. Field of the Invention

The present invention generally relates to a basketball system and, in particular, to a portable basketball system.

2. Description of Related Art

As the game of basketball has increased in popularity, a large number of people have purchased basketball systems for use at their homes. Previous basketball systems were typically permanently mounted in the driveway or other dedicated location at the person's house. Many people, however, do not have the space or desire to have a basketball system permanently located at their house. Accordingly, portable basketball systems have been developed in order to allow the basketball system to be moved or transported.

Conventional portable basketball systems must have sufficient weight to hold the basketball goal in a generally fixed or stationary position while playing the game of basketball. Disadvantageously, some conventional portable basketball systems require a large amount of weight to maintain the basketball goal in a fixed or stationary position. The large amount of weight makes these known basketball systems difficult to move and it may require several people to move or set up the basketball goal. Additionally, these known basketball systems that require a large amount of weight may be prohibitively expensive for many consumers.

It is also known for portable basketball systems to use removable weights to hold the basketball goal in a fixed position while playing the game of basketball and then the weights are removed when it is desired to move the basketball goal. The removable weights, however, are often extremely heavy and difficult to move. In addition, the weights may create a safety hazard if the weights inadvertently fall or move. The removable weights also create a basketball system that is large and bulky.

Conventional portable basketball systems may also use a base with a hollow cavity for receiving ballast material such as sand or water. These conventional basketball systems allow the system to be moved where desired and then the base is filled with the ballast material to maintain the basketball goal in the fixed position. When it is desired to move the basketball goal, the ballast material may be removed from the base and the portable basketball system can then be moved.

Known portable basketball systems often include a support pole that supports the basketball goal above a playing surface. The support pole is often connected to the base by a through-hole that extends through the base. Disadvantageously, forming a through-hole in the base increases the weight of the base, which is undesirable because it increases the costs to ship the portable basketball system and it makes the system more difficult to transport. In addition, creating the through-hole in the base increases the time required to form the base, which further increases manufacturing costs. Further, the through-hole decreases the size of the hollow cavity inside the base, which allows less ballast material to be inserted into the base. Accordingly, a larger size base must be created in order to overcome the loss of space caused by the through-hole.

These conventional portable basketball goal systems are often marketed directly to consumers in retail stores. The large size of the portable basketball systems, however, may discourage or prevent consumers from purchasing the basketball system. In particular, consumers may be reluctant to purchase a large portable basketball system because of the amount of effort required to transport the system from the store to their homes.

Conventional portable basketball systems are generally shipped unassembled and the manufacturer typically includes a number of fasteners with the system to allow the retailer or consumer to assemble the basketball system. Many manufacturers include several extra fasteners with the system in case one or more of the fasteners are lost or broken. Undesirably, this increases the cost of the portable basketball system. On the other hand, if extra fasteners are not included by the manufacturer and one or more of the fasteners are lost or broken, then the retailer or consumer must find suitable replacement fasteners and this may be very difficult for consumers who are not accustomed to assembling larger structures such as portable basketball systems.

Many customers may also be intimidated by the assembly of these complex basketball systems. For example, conventional portable basketball systems typically require connection of numerous fasteners to interconnect the various components such as the base, support pole, backboard and rim assembly. Many consumers may be unable or unwilling to connect the numerous fasteners of conventional basketball systems. The assembly of conventional portable basketball systems may also require the use of tools. Consumers, however, may not have the correct tools and they may be forced to purchase or borrow the necessary tools. The lack of proper tools may make some consumers reluctant to purchase conventional portable basketball systems, and may even prevent some customers from doing so.

BRIEF SUMMARY OF THE INVENTION

A need therefore exists for a portable basketball system that eliminates the above-described disadvantages and problems.

One aspect of the portable basketball system is a base that can be filled with ballast material such as sand or water and a support pole that can be connected to the base. Desirably, the support pole can be connected to the base without requiring the use of tools. Tools, however, could be used to connect the support pole to the base if desired.

Another aspect of the portable basketball system is the support pole is capable of being connected to the base without requiring the use of fasteners. This may allow the portable basketball system to be quickly and easily assembled. It may also make the portable basketball system easy to disassemble. The support pole, however, could be connected to the base by using one or more fasteners.

Yet another aspect of the portable basketball system is the support pole may be pivotally or rotatably connected to the base by an axle that allows the support pole to be moved between a first position in which the support pole is movable relative to the base and a second position in which the support pole is held in a generally fixed position relative to the base. The support pole is preferably located in a generally upright or vertical position when the support pole is in the second position to allow the game of basketball to be played. Preferably a locking member is used to secure the support pole in the second position and the locking member may be held in a receiving portion by a snap, friction or interference fit to secure the support pole in the second position.

A further aspect is the portable basketball system that may include a support member which is sized and configured to support a basketball goal and backboard above a playing surface, and the support member is movable into a playing position in which the support member is held in a generally stationary position. The portable basketball system may also include an axle connected to the support member, a wheel connected to the axle, a locking member connected to the support member, and a base including a axle receiving portion that connects the axle to the base and a locking member receiving portion that is sized and configured to receive at least a portion of the locking member when the support member is in the playing position. The portable basketball system may also include a wheel receiving portion and a support member receiving portion that are formed in the base. The base is preferably constructed from blow-molded plastic, and the axle receiving portion and the locking member receiving portion are preferably integrally formed in the base as part of a one-piece structure. The portable basketball system may also include a lip that is disposed proximate the locking member receiving portion and the lip is deformable to allow the locking member to be securely received within the locking member receiving portion.

Yet another aspect is a basketball system that may include a support member that is sized and configured to support a basketball goal above a playing surface in a playing position, an axle connected to the support member, at least one wheel connected to the axle, a locking member connected to the support member, and a base. The base includes a wheel receiving portion that receives at least a portion of the wheel and support member, an axle receiving portion that connects the axle to the base, a support member receiving portion that receives at least a portion of the support member when the support member is in the playing position, and a locking member receiving portion that receives at least a portion of the locking member when the support member is in the playing position. The base may be constructed from blow-molded plastic and the wheel receiving portion, axle receiving portion, support member receiving portion and locking member receiving portion are preferably integrally formed in the base as part of a one piece structure.

A further aspect is an apparatus that allows a basketball goal to be supported above a playing surface. The apparatus preferably includes a base, a support member that is movable between a first position and a second position relative to the base, the first position allowing the support member to rotate relative to the base and the second position maintaining the support member in a generally fixed position relative to the base, an axle that pivotally connects the support member to the base, and a locking member that is sized and configured to maintain the support member in the second position. The apparatus may include a locking member receiving portion formed in the base, the locking member receiving portion being configured to receive and retain the locking member when the support member is in the second position. A lip may be disposed proximate the locking member receiving portion and the lip is preferably deformable to allow the locking member to be securely received within the locking member receiving portion. The locking member receiving portion may also include a first groove that is sized and configured to receive a first end of the locking member and a second groove that is sized and configured to receive a second end of the locking member.

Advantageously, the apparatus may include a wheel receiving portion that is formed in the base and sized and configured to receive at least a portion of the wheel and support member. The apparatus may further include a support member receiving portion that is formed in the base and sized and configured to receive at least a portion of the support member in the second position. The support member receiving portion may include at least one surface that is sized and configured to engage the support member when the support member is in the playing position. In addition, the apparatus may include an axle receiving portion that is formed in the base and sized and configured to connect the axle to the base. Preferably the axle receiving portion includes a first notch that is sized and configured to receive a first end of the axle and a second notch that is sized and configured to receive a second end of the axle. Further, the wheel receiving portion, an axle receiving portion, a support member receiving portion and a locking member receiving portion may be integrally formed in the base as part of a one-piece structure.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

The present invention is directed towards a portable basketball system. The principles of the present invention, however, are not limited to portable basketball system. It will be understood that, in light of the present disclosure, the portable basketball system disclosed herein can be successfully used in connection with other types of basketball and sporting equipment.

Additionally, to assist in the description of the portable basketball system, words such as top, bottom, front, rear, right and left are used to describe the accompanying figures. It will be appreciated, however, that the present invention can be located in a variety of desired positions—including various angles, sideways and even upside down. A detailed description of the portable basketball system now follows.

Figure 1:
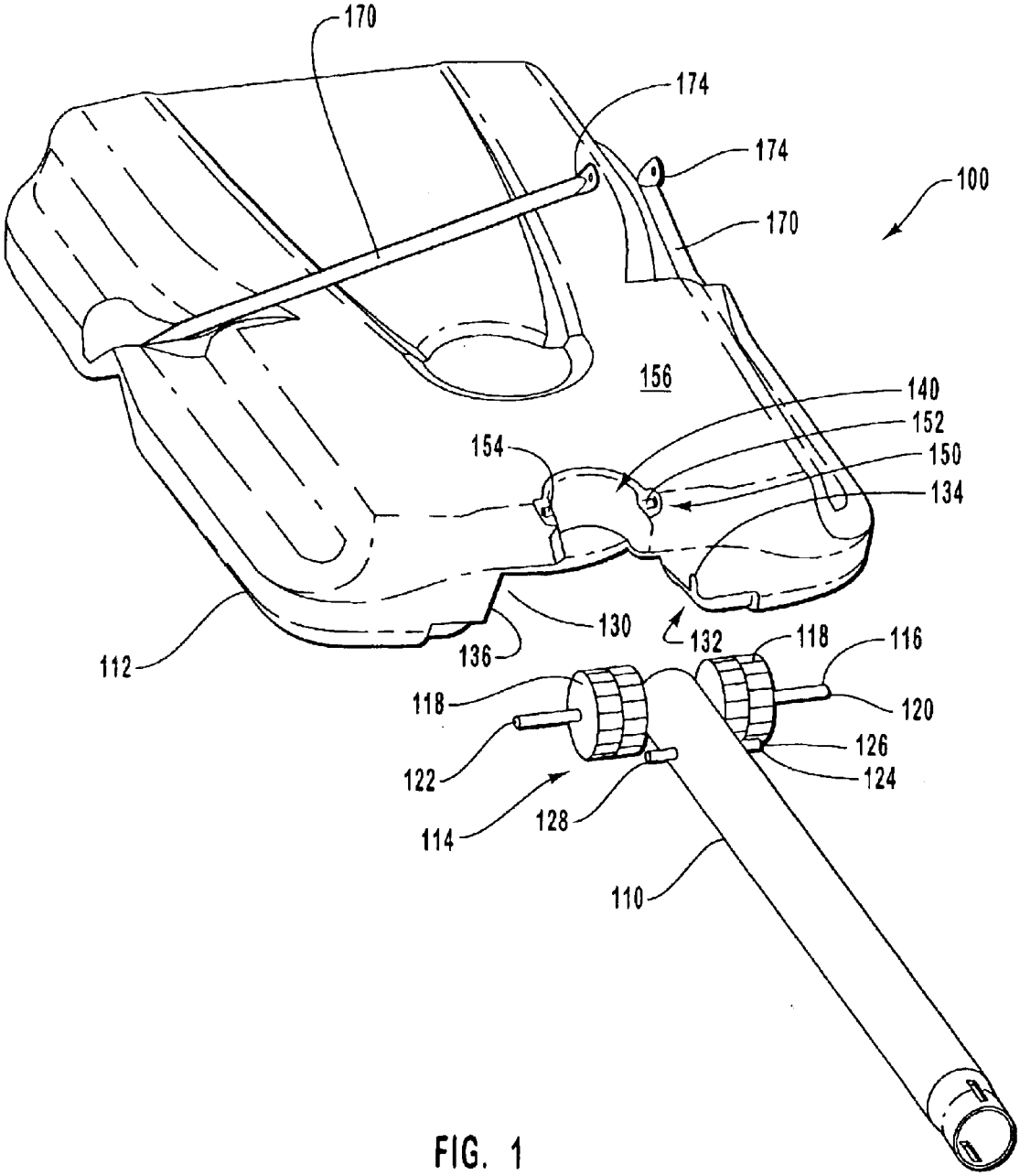
FIG. 1 is a perspective view of a preferred embodiment of a support pole and base for a portable basketball system, illustrating the support pole and base in an unassembled configuration.
Figure 2:
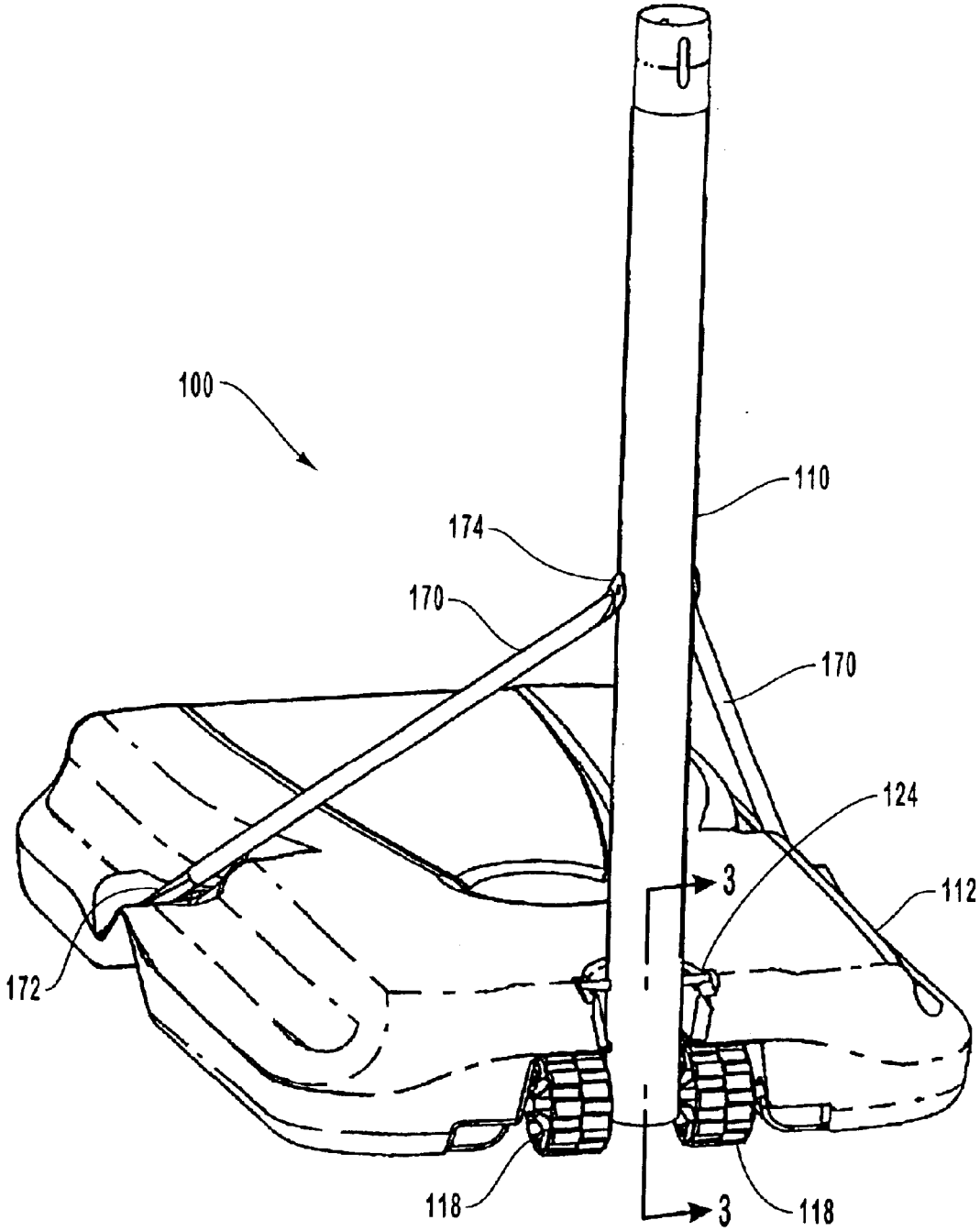
FIG. 2 is perspective view of the portion of the portable basketball system shown in FIG. 1, illustrating the support pole attached to the base and the support pole in a second or playing position.

As seen in FIG. 1, a portable basketball goal system 100 includes a support pole 110 that is used to support a basketball rim assembly and backboard (not shown) above a playing surface. In particular, the support pole 110 is preferably used to support a basketball rim assembly and backboard ten (10) feet above a playing surface, which is the regulation height of a basketball rim. The support pole 110, however, may support the basketball rim at any desired distance from the playing surface and the height of the basketball rim may be adjustable.

The support pole 110 desirably consists of several components that are connected together to form the support pole. Advantageously, this may allow the portable basketball system 100 to be more easily shipped and transported. For example, the support pole 110 may consist of two or more elongated tubular members that are connected to form the support pole. An exemplary embodiment of connecting the elongated members is disclosed in Assignee's U.S. Pat. No. 5,090,837 which is hereby incorporated by reference in its entirety. One skilled in the art will appreciate that the support pole 110 may also consist of a single component, including a telescoping assembly, or have other suitable configurations.

The support pole 110 is preferably constructed from a relatively high-strength material such as metal and the pole preferably has a generally cylindrical configuration. It will be understood that the support pole 110 may be constructed from any suitable materials and the pole may have any appropriate shape and configuration depending, for example, upon the intended use of the portable basketball system 100. For instance, the support pole 110 may have a triangular, square, rectangular, oval, oblong or other cross-sectional configuration.

The support pole 110 includes a lower end 114 that is connected to the base 112 by an axle 116. The lower end 114 of the support pole 110 preferably has a generally planar end and the support pole is preferably pivotally connected to the base 112. The pivotal connection of the support pole 110 to the base advantageously allows the support pole to be moved between a first position in which the support pole is movable relative to the base 112 and a second position in which the support pole is secured in a generally upright or vertical configuration. The second position preferably securely holds the support pole 110 in an upright position to allow the game of basketball to be played. It will be appreciated, however, that the support pole 110 does not have to be in a vertical configuration in the second position to allow the game of basketball to be played.

The base 112 is preferably constructed from plastic and it includes a hollow cavity to allow ballast materials such as sand or water to fill the base. In particular, the base 112 is preferably constructed from blow-molded plastic as a unitary, one-piece component. The base 112, however, could be constructed using other suitable processes such as injection molding and other materials with suitable characteristics may be used to construct the base. Further, the base 112 could be constructed from one or more components that are connected together and the base, as described in more detail below, preferably includes one or more features that are integrally formed in the base during the manufacturing process. Exemplary embodiments of a base and other features that may be used in connection with the portable basketball system 100 are disclosed and described in Assignee's U.S. Pat. No. 5,259,612 entitled Portable Support for a Basketball Goal System; U.S. Pat. No. 5,354,049 entitled Apparatus and Method for Packaging a Portable Basketball System; U.S. Pat. No. Des. 351,881 entitled Base for a Basketball Goal; U.S. Pat. No. Des. 351,882 entitled Base for a Basketball Goal; U.S. Pat. No. 5,836,838 entitled Portable Folding Basketball Goal System; U.S. Pat. No. 6,432,003 entitled Adjustable Wheel Engagement Assembly for Basketball Goal Systems; and U.S. Pat. No. 6,656,065 entitled Wheel Mounted Adjustable Roller Support Assembly for a Basketball Goal System. Each of these patents and applications is incorporated by reference in their entireties.

As seen in FIG. 1, the axle 116 is preferably an elongated member such as a pin, rod, tube and the like with a first end 120 and a second end 122. The axle 116 is preferably connected to the support pole 110 by inserting it through one or more openings in the pole and the first and second ends 120, 122 preferably extend outwardly from the support pole. It will be appreciated, however, that the axle 116 could be attached to the support pole 110 in any desired manner and one or more braces, brackets or other structures may be used to attach the axle to the support pole.

One or more wheels 118 are connected to the axle 116 and the wheels are configured to facilitate movement of the portable basketball system 100. Preferably one or more wheels 118 are disposed on each side of the support pole 110. In particular, two wheels 118 are disposed on a first side of the support pole 110 and two wheels are disposed on a second side of the support pole. The wheels 118 desirably rotate about the axle 116 and the wheels may include bearings to allow the wheels to rotate more easily. One skilled in the art will appreciate that only a single wheel could be used and the wheels may be positioned in any suitable configuration or arrangement. In addition, one skilled in the art will appreciate that wheels do not have to be used and skid plates or other suitable mechanisms may be used to facilitate movement of the portable basketball system 100.

A locking member 124 is also attached to the lower end 114 of the support pole 110 and the locking member is preferably an axle, pin, rod, tube or other type of elongated member that is inserted through one or more openings in the support pole. The locking member 124 preferably includes a first end 126 that extends from one side of the support pole 110 and a second end 128 that extends from another side of the support pole. The locking member 124, as described in more detail below, is preferably used to secure the support pole 110 in the second position in which the support pole is generally vertically aligned to allow a basketball goal to be positioned above a playing surface. It will be appreciated that the locking member 124 may be attached to the base 112 or other suitable part of the portable basketball system 100 if desired.

The base 112 includes a wheel receiving potion 130 that is sized and configured to receive at least a portion of the lower end 114 of the support pole 110 and the wheels 118 when the support pole is connected to the base. Desirably, the wheel receiving portion 130 allows the wheels 118 to rotate about the axle 116. Additionally, the wheel receiving portion 130 is preferably sized and configured to receive the support pole 110 whether the support pole is in the first position or the second position.

An axle receiving portion 132 is also formed in the base 112 and it desirably includes a first axle receiving portion 134 disposed on one side of the wheel receiving portion 130 and a second axle receiving portion 136 disposed on another side of the wheel receiving portion. The first and second axle receiving portions 134, 136 are preferably notches, grooves or receiving members that are sized and configured to receive the first and second ends 120, 122 of the axle 116. In particular, as best seen in FIGS. 1, 3 and 4, the first and second axle receiving portions 134, 136 are preferably downwardly extending notches that are sized and configured to receive the first and second ends 120, 122 of the axle 116.

Desirably, the first and second ends 120, 122 of the axle 116 are received within the first and second axle receiving portions 134, 136 by a snap, interference or friction fit in order to securely connect the axle to the base 112. For example, the openings to the first and second axle receiving portions 134, 136 may be sized slightly smaller than the first and second ends 120, 122 of the axle 116. Thus, when the first and second ends 120, 122 of the axle 116 are inserted into the openings of the first and second axle receiving portions 134, 136, the openings deform or deflect to allow the axle to be received within the axle receiving portions. The openings then resiliently or elastically return to their original positions to retain the axle 116 within the axle receiving portions 132. It will be appreciated that the axle 116 may be able to rotate within the axle receiving portions 132 or the axle may be held in a fixed position depending, for example, upon the type of wheels 118 attached to the axle. It will also be appreciated that the axle receiving portions 132 may have other suitable shapes and configurations depending, for example, upon the shape and configuration of the axle 116 and/or wheel receiving portion 130. Further, it will be appreciated that the axle 116 may be attached to the base 112 using other types of suitable structures such as braces, brackets, tabs, fasteners, and the like.

Figure 3:
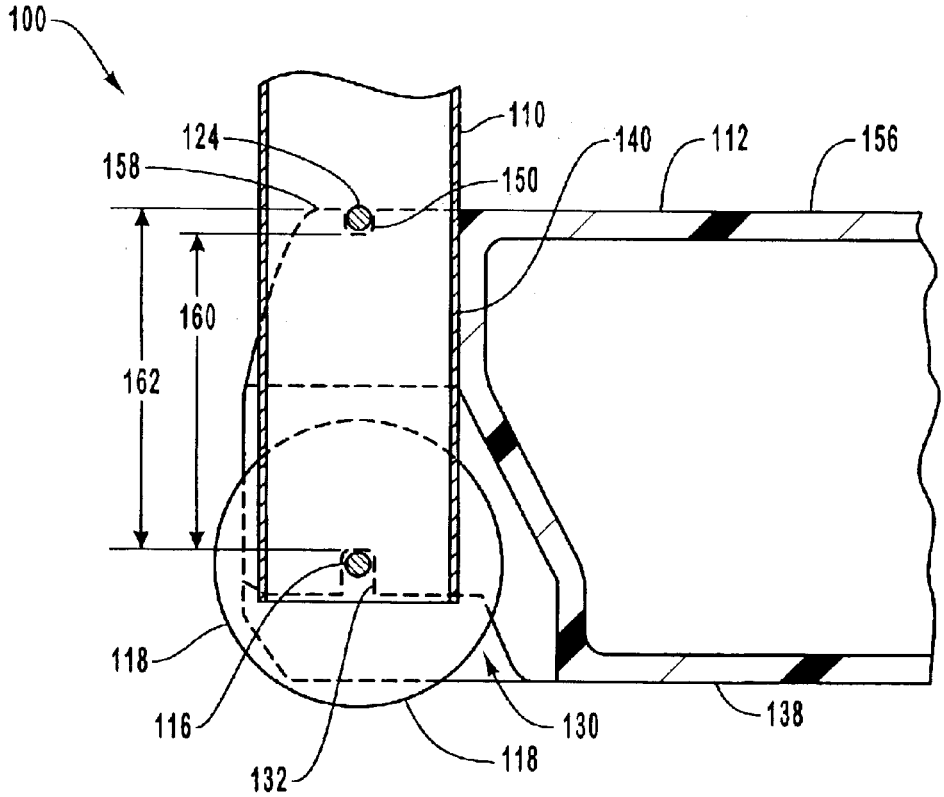
FIG. 3 is a partial cross-sectional side view along lines 3—3 of a portion of the portable basketball system shown in FIG. 2, illustrating the support pole in the second or playing position.
Figure 4:
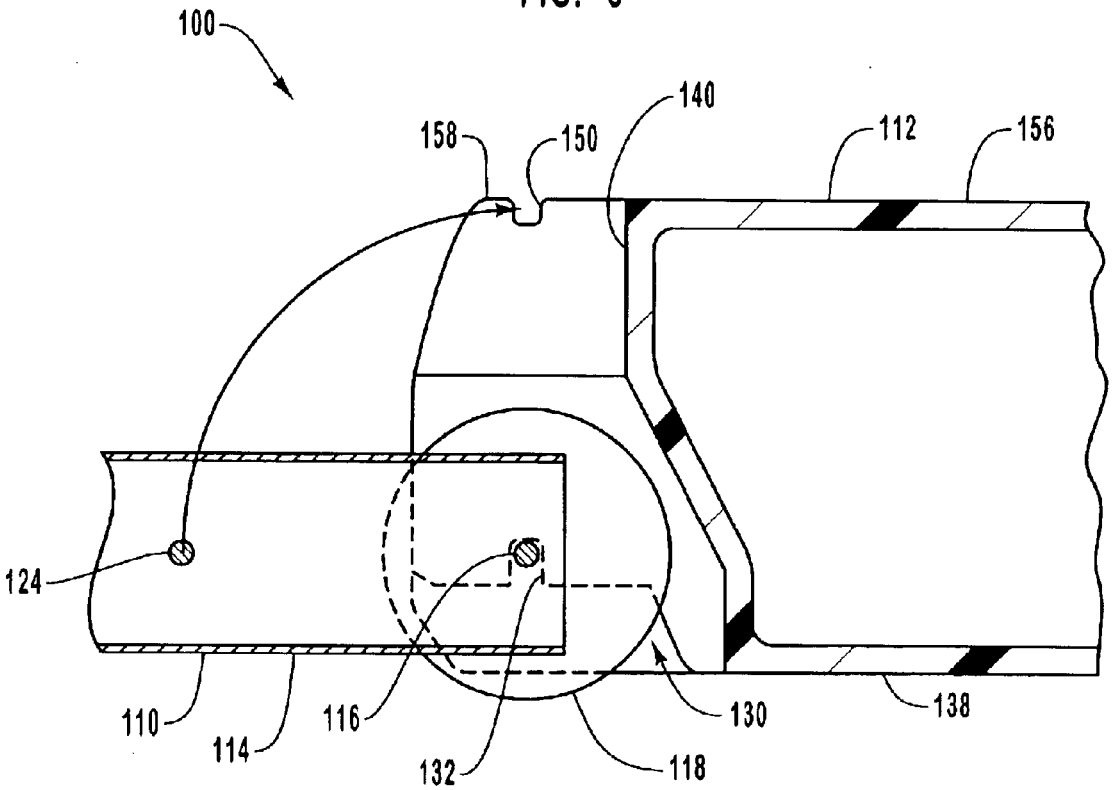
FIG. 4 is a partial cross-sectional side view along lines 3—3 of a portion of the portable basketball system shown in FIG. 2, illustrating the support pole in the first position.
Figure 5:
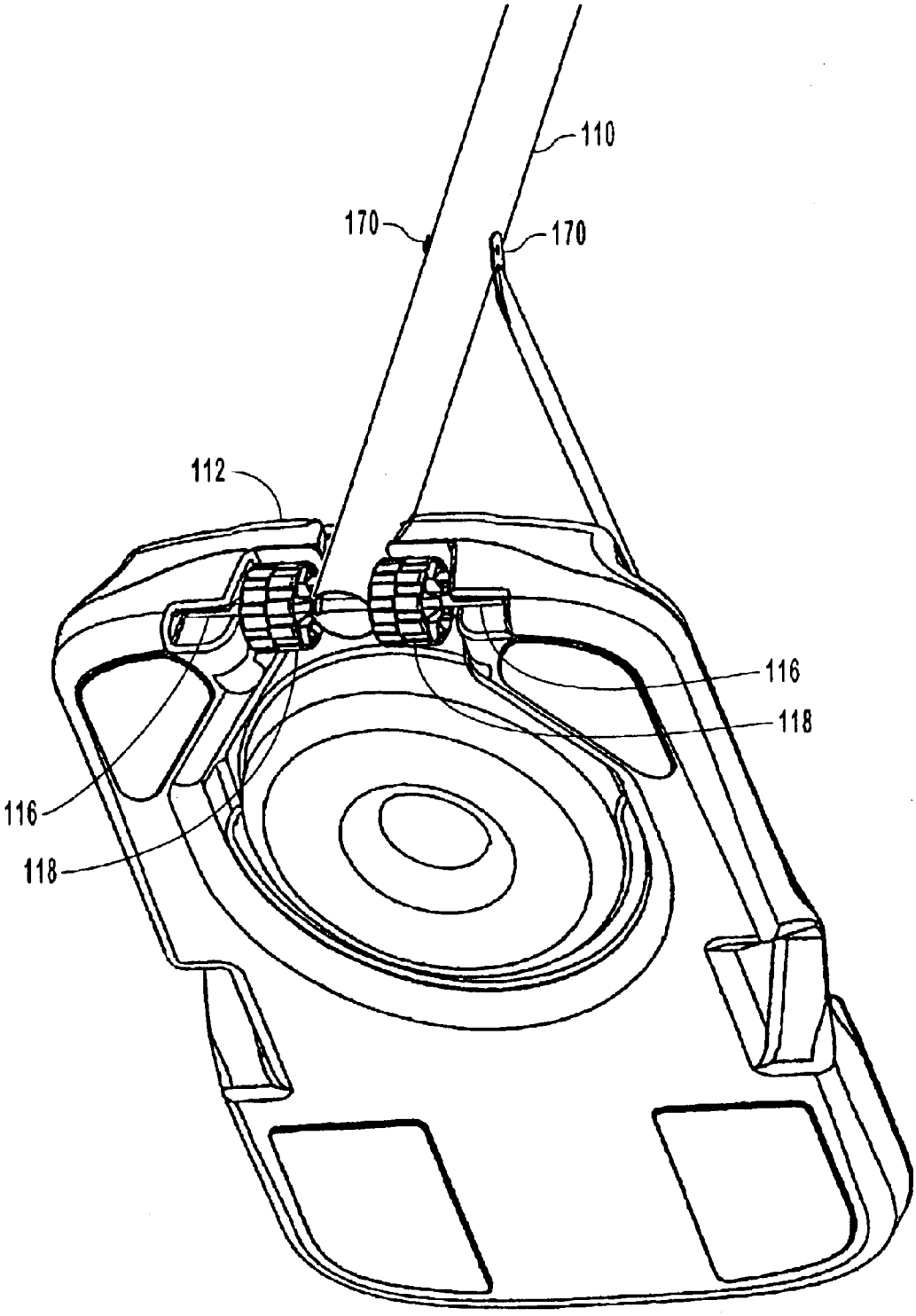
FIG. 5 is a bottom perspective view of the portable basketball system shown in FIG. 1.

As best seen in FIGS. 3 and 4, the lowermost portion of the wheel 118 preferably extends beyond the bottom surface 138 of the base 112. This allows the wheel 118 to facilitate movement of the portable basketball system 100 whether the support pole 110 is in the first position or the second position. Other embodiments of a wheel and other related features that can be used in connection with the portable basketball system 100 are disclosed in Assignee's U.S. Pat. No. 6,656,065 and entitled Wheel Mounted Adjustable Roller Support Assembly for a Basketball Goal System, which is hereby incorporated by reference in its entirety.

The base 112 also includes a support pole receiving portion 140 that is sized and configured to receive the support pole 110 when the support pole is in the second position. The support pole receiving portion 140 may simply receive the support pole 110 in the second position or the support pole receiving portion may include one or more surfaces that are sized and configured to contact a portion of the support pole when it is in the second position, as shown in FIGS. 3 and 4. For example, the support pole receiving portion 140 may have a configuration similar to the support pole 110 and it may be configured to help maintain the support pole in the second position. Additionally, the support pole receiving portion 140 may be size and configured to engage the support pole 110 by a snap, friction or interference fit, for example, to help maintain the support pole in the second position. It will be appreciated that various braces, brackets, tabs, fasteners, and the like may also be used in connection with the support pole receiving portion 140 to help maintain the support pole 110 in the second position.

The base 112 also includes a locking member receiving portion 150 that includes a first groove 152 that is sized and configured to receive the first end 126 of the locking member 124 and a second groove 154 that is sized and configured to receive the second end 128 of the locking member. The locking member receiving portion 150 is preferably located near the upper surface 156 of the base 112 and it preferably securely maintains the support pole 110 in the second position.

As shown in FIG. 4, when the support pole 110 is in the first position, the axle 116 is disposed within the axle receiving portion 132 and the support pole is rotatable relative to the base 112. When the support pole 110 is in the second position, the locking member 124 is disposed within the locking member receiving portion 150 and the support pole is desirably maintained in the second position. In particular, as the support pole 110 is rotated from the first position to the second position, the locking member 124 traverses a lip 158 disposed near the locking member receiving portion 150. Because the minimum distance 160 separating the axle 116 from the locking member 124 is less than the minimum distance 162 separating the axle from the top of the lip 158, the lip deforms or deflects to allow the locking member to be received within the locking member receiving portion 150. The lip 158 preferably resiliently or elastically returns to its original position to secure the locking member 124 within the locking member receiving portion 150. One skilled in the art will understand that various braces, brackets, tabs, fasteners, and the like may also be used to secure the locking member 124 within the locking member receiving portion 150.

The wheel receiving portion 130, axle receiving portion 132, support pole receiving portion 140 and locking member receiving portion 150 can be integrally formed in the base 112 as part of a unitary, one-piece structure. In particular, if the base 112 is constructed from blow-molded plastic, then the wheel receiving portion 130, axle receiving portion 132, support pole receiving portion 140 and locking member receiving portion 150 can be formed as an integral part of the base. Significantly, because the wheel receiving portion 130, axle receiving portion 132, support pole receiving portion 140 and locking member receiving portion 150 can be simultaneously formed, that may decrease the time required to manufacture or construct the base 112. The base 112, however, could be constructed from two or more components that are interconnected and the wheel receiving portion 130, axle receiving portion 132, support pole receiving portion 140 and/or locking member receiving portion 150 do not have to be integrally or simultaneously formed in the base 112.

Advantageously, the portable basketball system 100 provides a relatively simple and inexpensive way to attach the support pole 110 to the base 112. Significantly, tools and/or fasteners are not required to attach the support pole 110 to the base 112.

In order to assemble the portable basketball system 100, the axle 116 is connected to the lower end 114 of the support pole 110 and the wheels 118 are connected to the axle. The locking member 124 is also attached to the lower end 114 of the support pole 110. The support pole 110 is then positioned near the base 112, as shown in FIG. 1, and the base may then be lifted over the axle 116 such that the first and second ends 120, 122 of the axle are received within the first and second portions 134, 136 of the axle receiving portion 132. It will be appreciated that one or more guiding members may be used to guide the axle 116 into the axle receiving portions 132. It will be appreciated that the axle receiving portion 132 may have other suitable configurations depending, for example, upon the intended use of the portable basketball system 100. For example, the axle receiving portion 132 may have a generally J-shaped configuration in order to help secure the axle within the axle receiving portion. The axle receiving portion 132 may also consist of an elongated slot or have other suitable configurations if desired.

The support pole 110 is then pivoted or rotated upwardly about the axle 116 from the first position into the second position in which the locking member 124 is received within the locking member receiving portion 150. The support pole 110 is preferably securely held in the second position by a snap, friction or interference fit. The braces 170 can then be connected to the support pole 110 to help maintain the pole in the second position. Thus, the portable basketball system 100 can be quickly and easily assembled.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A portable basketball system comprising:

a support member that is sized and configured to support a basketball goal and backboard above a playing surface, the support member being movable into a playing position in which the support member is held in a generally stationary position;

an axle connected to the support member;

at least one wheel connected to the axle, the wheel being sized and configured to facilitate movement of the portable basketball system;

a locking member connected to the support member;

a base including an axle receiving portion that connects the axle to the base and a locking member receiving portion that is sized and configured to receive at least a portion of the locking member when the support member is in the playing position;

a lip disposed proximate the locking member receiving portion, the lip being deformable to allow the locking member to be securely received within the locking member receiving portion.

2. The portable basketball system as in claim 1, further comprising a wheel receiving portion formed in the base, the wheel receiving portion being sized and configured to receive at least a portion of the wheel and support member.

3. The portable basketball system as in claim 1, further comprising a support member receiving portion formed in the base, the support member receiving portion being sized and configured to receive at least a portion of the support member in the playing position.

4. The portable basketball system as in claim 1, wherein the locking member receiving portion includes a groove that receives the locking member.

5. The portable basketball system as in claim 1, wherein the locking member is securely held in the locking member receiving portion by a snap fit connection.

6. The portable basketball system as in claim 1, wherein the base is constructed from blow-molded plastic and the axle receiving portion and the locking member receiving portion are integrally formed in the base as part of a one-piece structure.

7. A basketball system comprising:

a support pole including a playing position in which the support pole is sized and configured to support a basketball goal above a playing surface;

an axle connected to the support member;

at least one wheel connected to the axle;

a locking member connected to the support pole; and a base comprising:

a wheel receiving portion that receives at least a portion of the wheel and support pole;

an axle receiving portion that connects the axle to the base;

a support pole receiving portion that receives at least a portion of the support pole when the support pole is in the playing position; and a locking member receiving portion that receives at least a portion of the locking member when the support pole is in the playing position.

8. The basketball system as in claim 7, wherein the base is constructed from blow-molded plastic and the wheel receiving portion, axle receiving portion, support pole receiving portion and locking member receiving portion are integrally formed in the base as part of a one piece structure.

9. The basketball system as in claim 7, wherein the axle receiving portion includes a first notch that is sized and configured to receive a first end of the axle and a second notch that is sized and configured to receive a second end of the axle.

10. The basketball system as in claim 7, wherein the support pole receiving portion includes at least one surface that is sized and configured to engage the support pole when the support pole is in the playing position.

11. The basketball system as in claim 7, wherein the locking member receiving portion includes a first groove that is sized and configured to receive a first end of the locking member and a second groove that is sized and configured to receive a second end of the locking member.

12. The basketball system as in claim 7, wherein the locking member is securely held in the locking member receiving portion by a snap fit connection.

13. The basketball system as in claim 7, further comprising a lip disposed proximate the locking member receiving portion, the lip being deformable to allow the locking member to be securely received within the locking member receiving portion.

14. An apparatus that allows a basketball goal to be supported above a playing surface, the apparatus comprising:

a base;

a support pole that is movable between a first position and a second position relative to the base, the first position allowing the support pole to rotate relative to the base and the second position maintaining the support pole in a generally fixed position relative to the base;

an axle that pivotally connects the support pole to the base; and a locking member that is sized and configured to maintain the support pole in the second position.

15. The apparatus as in claim 14, further comprising a locking member receiving portion formed in the base, the locking member receiving portion being configured to receive and retain the locking member when the support pole is in the second position.

16. The apparatus as in claim 15, wherein the locking member receiving portion includes a groove that receives at least a portion of the locking member.

17. The apparatus as in claim 15, wherein the locking member is securely held in the locking member receiving portion by a snap fit connection.

18. The apparatus as in claim 15, further comprising a lip disposed proximate the locking member receiving portion, the lip being deformable to allow the locking member to be securely received within the locking member receiving portion.

19. The apparatus as in claim 15, wherein the locking member receiving portion includes a first groove that is sized and configured to receive a first end of the locking member and a second groove that is sized and configured to receive a second end of the locking member.

20. The apparatus as in claim 14, further comprising a wheel receiving portion formed in the base, the wheel receiving portion being sized and configured to receive at least a portion of the wheel and support pole.

21. The apparatus as in claim 14, further comprising a support pole receiving portion formed in the base, the support pole receiving portion being sized and configured to receive at least a portion of the support pole in the second position.

22. The apparatus as in claim 21, wherein the support pole receiving portion includes at least one surface that is sized and configured to engage the support pole member when the support pole is in the second position.

23. The apparatus as in claim 14, further comprising an axle receiving portion form in the base, the axle receiving portion being sized and configured to connect the axle to the base.

24. The apparatus as in claim 23, wherein the axle receiving portion includes a first notch that is sized and configured to receive a first end of the axle and a second notch that is sized and configured to receive a second end of the axle.

25. The apparatus as in claim 14, further comprising a wheel receiving portion, an axle receiving portion, a support pole receiving portion and a locking member receiving portion that are integrally formed in the base as part of a one-piece structure.

26. An apparatus that is sized and configured to support a basketball goal in a playing position relative to a playing surface so that the game of basketball can be played, the apparatus comprising:

a base including an axle receiving portion, a locking member receiving portion and an elongated support member receiving portion that are integrally formed in the base as part of a unitary, one-piece structure;

an elongated support member at least partially disposed within the elongated support member receiving portion in the base when the basketball goal is in the playing position;

an axle connected to the support member, at least a portion of the axle being disposed within the axle receiving portion in the base when the basketball goal is in the playing position; and a locking member connected to the support member, at least a portion of the locking member being disposed within the locking member receiving portion in the base when the basketball goal is in the playing position.

27. The apparatus as in claim 26, further comprising a first position in which the elongated support member is movable relative to the base and a second position in which the elongated support member is held in a generally fixed position relative to the base.

28. The apparatus as in claim 26, further comprising a wheel receiving portion that are integrally formed in the base as part of a unitary, one-piece structure.

29. The apparatus as in claim 26, further comprising at least one wheel connected to the axle.

30. The apparatus as in claim 26, wherein the axle receiving portion includes at least one notch formed in the base.

31. The apparatus as in claim 26, wherein the locking member receiving portion includes at least one groove formed in the base.

32. The apparatus as in claim 26, further comprising a deformable lip that is sized and configured to retain the locking member in a fixed position relative to the base when the basketball goal is in the playing position.

33. The apparatus as in claim 26, wherein the locking member is secured within the locking member receiving portion by a snap fit.

34. A basketball system comprising:

a base including an axle receiving portion and a locking member receiving portion;

an axle being disposed within the axle receiving portion in the base;

a support pole connected to the axle, the support pole being sized and configured to support a basketball goal and backboard above a playing surface, the support pole being movable between a first position in which the support pole is pivotally connected to the base and a second position in which the support pole is held in a generally fixed position relative to the base; and a locking member connected to the support pole, the locking member being disposed within the locking member receiving portion in the base when the support pole is in the second position to secure and retain the support pole in the generally fixed position.

35. The apparatus as in claim 34, further comprising at least one wheel connected to the axle.

36. The apparatus as in claim 34, wherein the axle receiving portion includes at least one notch formed in the base.

37. The apparatus as in claim 34, wherein the locking member receiving portion includes at least one groove formed in the base.

38. The apparatus as in claim 34, further comprising a deformable lip that is sized and configured to retain the locking member in a fixed position relative to the base when the basketball goal is in the playing position.

39. The apparatus as in claim 34, wherein the locking member is secured within the locking member receiving portion by a snap fit.

* * * * *

UNITED STATES PATENT AND TRADEMARK OFFICE

CERTIFICATE OF CORRECTION

PATENT NO. : 6,866,596 B2
DATED : March 15, 2005
INVENTOR(S) : Steed et al.

It is certified that error appears in the above-identified patent and that said Letters Patent is hereby corrected as shown below:

Column 3,
Line 14, before “axle” change “a” to -- an --.

Column 4,
Line 33, after “intended to” change “limits” to -- limit --.
Line 60, after “basketball” change “system.” to -- systems. --.

Column 7,
Line 59, change “may be size” to -- may be sized --.

Column 11,
Line 23, after “receiving portion” change “form” to -- formed --.

Column 12,
Line 5, before “integrally formed” change “are” to -- is --.

Signed and Sealed this

Sixteenth Day of August, 2005

JON W. DUDAS
*Director of the United States Patent and Trademark Office*